US007641476B2

(12) United States Patent
Didur et al.

(10) Patent No.: US 7,641,476 B2
(45) Date of Patent: Jan. 5, 2010

(54) ROTATABLE MAGNETIC ELECTRICAL CONNECTOR

(76) Inventors: David Didur, 18 Hook Avenue, Suite 102, Toronto, Ontario (CA) M6P 1T4; Larry Ellero, 71 Nadia Avenue, Woodbridge, Ontario (CA) L4L 8P2

( * ) Notice: Subject to any disclaimer, the term of this patent is extended or adjusted under 35 U.S.C. 154(b) by 0 days.

(21) Appl. No.: 11/917,599

(22) PCT Filed: Jun. 23, 2006

(86) PCT No.: PCT/CA2006/001047

§ 371 (c)(1),
(2), (4) Date: Jul. 22, 2008

(87) PCT Pub. No.: WO2007/003035

PCT Pub. Date: Jan. 11, 2007

(65) Prior Publication Data

US 2008/0305649 A1 Dec. 11, 2008

Related U.S. Application Data

(60) Provisional application No. 60/695,008, filed on Jun. 30, 2005.

(51) Int. Cl.
*H01R 13/60* (2006.01)

(52) U.S. Cl. ..... 439/39; 439/129

(58) Field of Classification Search ..... 439/38–40, 439/129

See application file for complete search history.

(56) References Cited

U.S. PATENT DOCUMENTS

| | | | | |
|---|---|---|---|---|
| 3,521,216 | A | 7/1970 | Tolegian | |
| 3,808,577 | A | 4/1974 | Mathauser | |
| 3,810,258 | A | 5/1974 | Mathauser | |
| 4,428,033 | A * | 1/1984 | McBride | 362/183 |
| 4,874,316 | A * | 10/1989 | Kamon et al. | 439/39 |
| 6,623,276 | B2 * | 9/2003 | Dalmau Ferrerfabrega et al. | 439/39 |
| 7,066,739 | B2 * | 6/2006 | McLeish | 439/39 |
| 2002/0086559 | A1 * | 7/2002 | Dalmau Ferrerfabrega et al. | 439/39 |
| 2008/0305649 | A1 * | 12/2008 | Didur et al. | 439/39 |

* cited by examiner

*Primary Examiner*—James Harvey
(74) *Attorney, Agent, or Firm*—Banner & Witcoff, Ltd.

(57) ABSTRACT

A rotatable quick disconnect electrical connector assembly is provided. The assembly includes a male component and a female component, which have a mating fit together and which have an electrical connection when in mating contact. The connection is further enhanced by magnetic attraction, one of either the male or female components having a magnetic material and the other having a magnet-sensitive material. Each of the male and female components has a generally circular cross-section, to permit relative rotation through unlimited degrees in clockwise and counterclockwise directions. The components may be made separately. A system of such connectors is also provided (e.g. for displays).

14 Claims, 1 Drawing Sheet

ROTATABLE MAGNETIC ELECTRICAL CONNECTOR

FIELD OF THE INVENTION

The invention relates to electrical connectors, and in particular to connectors held together by magnetic force.

BACKGROUND OF THE INVENTION

Electrical connectors in two-part (male-female) format are well-known in the art. For example, a light bulb connected threadably to a standard AC light fixture is a two-part connector. A contact at the base of the light fixture provides power to the light bulb which illuminates when powered.

However, such traditional connectors can be awkward and cumbersome to install or replace in certain locations (in ceilings, in or under furniture, cabinets, or display cases), or in limited space environments (such as offices, vehicles, boats, or RV's). It would be beneficial to provide an electrical connector that is simple to install and maintain. In particular, it would be beneficial if such installation and maintenance could be done manually, without tools.

Traditional connectors may also be difficult to secure. Many appliances are powered using a cord which plugs into an electrical socket. The cord provides a well-known tripping hazard. Inadvertent removal of the cord, physical injury and/or damage to the appliance may result. It would be beneficial to provide an electrical connector that reduces such hazards, and in particular reduces or eliminates the need for cord connection to a power source. It would also be beneficial to provide stability for appliances by preventing tipping from the socket.

To move an electrical appliance to face a different direction, it is frequently necessary to unplug and reposition the appliance before plugging the cord back in. This may be necessary to avoid cord hazards mentioned above. In some cases, the appliance and its cord location (and the location of the power outlet) may not permit the desired repositioning. It would be beneficial to provide a low-footprint power connector that enables an appliance to be repositioned within a single connector (by rotation), or positioned to engage another nearby connector simply and without cords.

Lighted display panels using multiple threaded light bulbs or other illuminated panels are known. However, it would be beneficial to provide a display panel that allows quick-release light bulbs to be installed and dismounted, to permit modular and changeable displays to be erected.

SUMMARY OF THE INVENTION

The invention provides a rotatable magnetic electrical connector.

According to a first aspect of the invention, a rotatable quick disconnect electrical connector assembly is provided. The assembly includes:

- a male component having a first electrical contact at a distal end thereof; and
- a female component having a mating fit with the male component.

The female component has a second electrical contact in its interior, which is situated so as to meet and contact the first electrical contact when the male and female components are mated together.

One of either the male component or the female component comprises a magnet mounted thereon, and the other of the male component or the female component comprises a magnet-sensitive material, so that the male and female components are attracted together by magnetic force.

Each of the male and female components has a generally circular cross-section, and at least one of said male component and said female component is rotatable with respect to the other component through unlimited degrees in clockwise and counterclockwise directions.

According to a second aspect of the invention, a male component is provided in accordance with the construction and features set out above.

According to a third aspect of the invention, a female component is provided in accordance with the construction and features set out above.

According to a fourth aspect of the invention, a system of electrical connectors is provided with a panel comprising a plurality of female components in accordance with the construction and features set out above. Each of the female components are adapted to receive at least one male component, all in accordance with the construction and features set out above.

BRIEF DESCRIPTION OF THE FIGURES

The preferred embodiments will now be described having reference to attached drawings, in which FIGS. 1A-3 show a rotatable magnetic electrical connector. In particular:

FIG. 1A shows a cross-sectional view of a female component of the electrical connector.

FIG. 3 shows an exploded (assembly) view of an assembled connector.

DETAILED DESCRIPTION

FIGS. 1A-3 show a rotatable magnetic electrical connector 10. The connector is a low voltage electrical connector in two parts. The connection is maintained by magnetic force and separated by pull force. Preferably, the disconnection is easily achieved by hand (without tools). In engaged state, the connector provides constant electrical connection in place, as well as through unlimited rotation of the male component 12 or the female component 14 in either clockwise or counterclockwise direction.

Figure 1A:
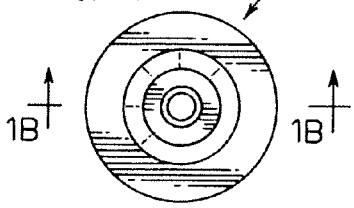
Figure 1B:
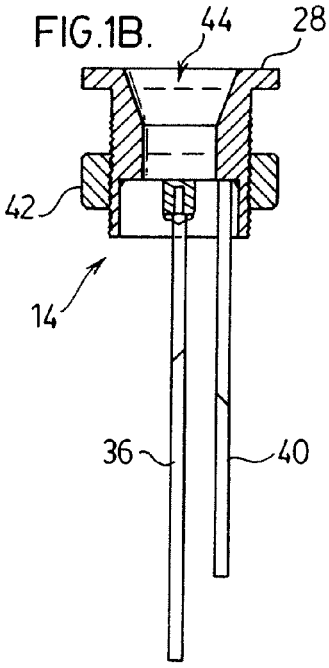
FIG. 1B shows the cross-sectional view along lines A-A of FIG. 1A.
Figure 1C:
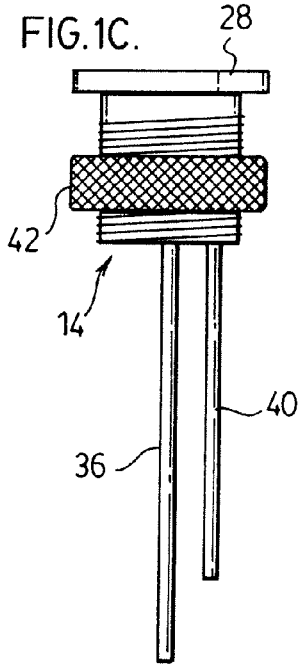
FIG. 1C shows the isometric view from lines B-B of FIG. 1A.
Figure 3:
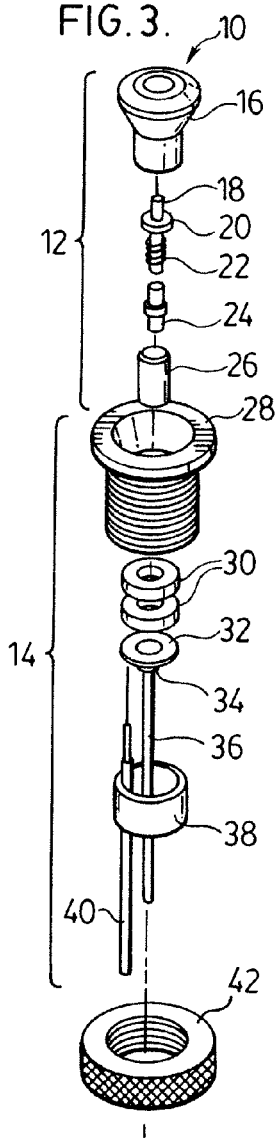
Figure 2A:
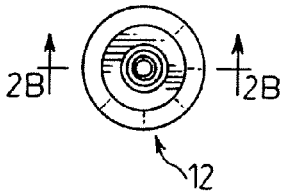
FIG. 2A shows a cross-sectional view of a male component of the connector.
Figure 2B:
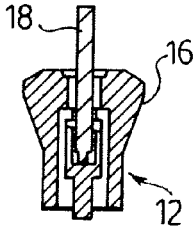
FIG. 2B shows the cross-sectional view along lines C-C of FIG. 2A.
Figure 2C:
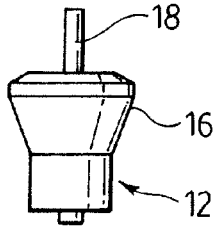
FIG. 2C shows the isometric view of the male component.

Beginning with FIG. 3, an assembly view is shown of the rotatable magnetic electrical connector 10, having two main components: a male component 12 and a female component 14. The female component is shown in more detail in FIGS. 1A-1C. The male component is shown in more detail in FIGS. 2A-2C.

The male component 12 is sized and shaped to snugly fit inside an interior cavity 44 of the female component 14. As shown, the male component 12 may be fully or partially tapered in shape, the female component 14 having an interior cavity 44 of the same tapered shape. The fit is intended to provide a close tolerance mating of the two components, which in turn provides sufficient friction to prevent slipping of one component relative to the other. Although various mating shapes of components may be used, it is preferred that the cross-sections of the male component and female component be generally circular. Preferably, the components are capable of secure mating relation without the need for other locating means or alignment means.

In comparison with a straight fit between the male and female components, the tapered shape is considered preferable for several reasons. The tapered shape is considered beneficial for closer tolerance between the components (approaching zero tolerance). Thus, the components can be made to have a very secure, "locked together" mating, even apart from their magnetic bond. In assembled state, the components resist side-to-side or pivotal movement relative to the center axis of the female component (i.e. the components do not rattle or slide relative to each other). However, by contrast to a straight fit manufactured to the same tolerance, the tapered fit does permit the frictional bond to be broken relatively easily by hand.

Functionally, the male component and female component are adapted for magnetic interconnection. As shown in the Figures, at least a portion of the male component 12 may be comprised of a magnet-sensitive metallic material, such as the housing 16, which is attracted by one or more magnets 30 in the female component 14. One type of magnet-sensitive material is stainless steel. The magnets may be rare earth magnets, such as neodymium, or any suitable magnetic material. Preferably, the magnets are ring-shaped and mounted proximate to the interior cavity of the female component.

Although having a magnetic interaction, the male and female components are not necessarily entirely metal. In particular, for various reasons, it may be desirable to manufacture the connector having sub-components made of plastic or another material. Most critical is that the electrical leads and contacts be made of a material that is functional to conduct electricity, and that the magnetic and magnet-sensitive portions of the male and female components co-operate to form a magnetic bond to retain the components together.

The electrical function of the connector is provided by wires (leads) 18, 36 and electrical contacts 24, 34, which may be physically brought into connection when the male and female components are mated together magnetically. In a preferred embodiment, one or both of the electrical contacts 24, 34 may be spring-biased, to facilitate secure connection. As shown in FIG. 3, the male component may include a steel coil spring 22 to bias the contact 24 (such as Tellurium) into abutment with the corresponding contact 34 in the female component (such as Tellurium). A black (negative) lead is also provided 40. Current is carried through the connector to a light bulb or appliance via lead 18.

In the male component, the electrical wires and contacts are provided to be housed within a housing 16 (e.g. stainless steel). To secure the electrical components in place, one or more washers may be provided 20. As shown in FIG. 3, the component may be packed with a pressure-fit retainer, such as a Nylatron retainer 26.

In the female component, the electrical wires and contacts are provided to be housed within a housing 28 (e.g. stainless steel). The magnet rings 30 preferably are mounted within the housing below the cavity 44. The interior parts are preferably secured using one or more washers 32. Suitable washers may be made of any insulating material, such as Delrin. As shown in FIG. 3, the component may be packed with a pressure-fit retainer, such as a Nylatron retainer 38 to guard against relative movement and wear within the female component.

For installation, the female component may also be provided with a nut 42 which engages a threaded exterior portion on the steel housing 28.

Preferably, the female component is adapted to fit into new and existing millwork (platforms, showcases, cabinets, tables, etc.), as well as wall board and paneling. The male component could be used as an attachment to LED and halogen light fixtures as well as, any low voltage AC DC appliance that conforms to accepted electrical standards (such as CSA, UL or European standards).

It is an advantage of the connector that its versatility allows for installation in horizontal, vertical and overhead positions, as well as providing 360-degree rotation, such as for light fixtures. The magnetic connection, as well as the snug fit of the components, provides the overall assembly with a high level of stability (against tipping, and lateral pull and "shearing" forces). This is achieved with a relatively small "footprint" of the female component. To illustrate, the female component (in use as a fixture/base for a table lamp) can have a footprint as small as about 1.25" in diameter. By contrast, a table lamp having a standard AC base can have a footprint between 4" and 10" in diameter or more.

Because the connector can be installed into existing millwork, multiple female components can be installed in handy locations, to permit male-component equipped appliances and light bulbs to be swapped in and out as desired. The small footprint and smooth top surface (which can be recessed to lie flush with the surface in which it is installed) allow the connector to be used in place of standard AC outlets in many locations. Reach from an outlet to an appliance is therefore less of a concern, and the connector can be used in place of a standard electrical cord, thereby providing a safer, and less-obtrusive connection.

To illustrate, the connectors may be used in multiple locations throughout the architecture of a boat or RV to provide quick release and installation of all fixtures (lights, radio, navigational tools, etc.) preferably without the use of tools. The fixtures will not tip over or come undone due to rough seas or roads, and all fixtures may be easily installed and uninstalled for versatility and ease of stowage.

In a possible display application, a plurality of connectors would be useful mounted in any type of grid pattern on one or more panels. Male components (such as lights) could be swapped in and out to provide a modular lighting display.

The foregoing is considered as illustrative only of the principles of the invention. Further, since numerous modifications and changes will readily occur to those skilled in the art, it is not desired to limit the invention to the exact processes, components and applications shown and described, and accordingly, all suitable modifications and equivalents may be resorted to, falling within the scope of the invention and the appended claims and their equivalents. For example, while specific materials are described in the foregoing disclosure, it is not intended to limit the scope to such materials, but materials having similar properties (e.g. magnet-sensitive, magnetic, insulating, etc.) may be substituted without limitation.

What is claimed is:

1. A rotatable quick disconnect electrical connector assembly, comprising:

a male component, comprising:

a first housing having a top end and a bottom end, at least a portion of the first housing having a taper, the bottom end having a substantially flat base; and first electrical lead running through the first housing from the top end through to the bottom end, so that a first electrical contact is exposed at the base; and a female component, comprising:

a second housing having a top end and a bottom end and defining an interior cavity open at the top end and having a substantially flat base inside the cavity, at least a portion of the cavity having a taper corresponding to the taper of the first housing of the male component, so that the male and female components are capable of a secure frictional fit when mated together and the assembly is resistant to contact separation under vertical, horizontal or radial loads; and a second electrical lead running through the second housing from the bottom end through to the cavity, so that a second electrical contact is exposed at the base of the cavity;

the first and second electrical contacts being situated so as to meet and contact each other when the male and female components are mated together;

one of either the male component or the female component having a magnet mounted thereon and the other of the male component or the female component having a magnet-sensitive material, so that the male and female components are attracted together by magnetic force;

each of the male and female components having a generally circular cross-section and at least one of the male component and the female component being rotatable with respect to the other component.

2. The connector assembly of claim 1, wherein the magnet is located on the female component.

3. The connector assembly of claim 2, wherein the magnet is located proximate to the base of the female component, the base of the male component having a magnet- sensitive material.

4. The connector assembly of claim 1, wherein the first housing of the male component has a first diameter at the top end and a second diameter at the bottom end, the first diameter being larger than the second diameter.

5. The connector assembly of claim 1, wherein the first housing of the male component includes a cylindrical portion, and the cavity of the female component includes a corresponding cylindrical portion.

6. The connector assembly of claim 5, wherein:

the tapered portions of the male and female components are located proximate to the top ends thereof and the cylindrical portions of the male and female components are located proximate to the bottom ends thereof.

7. The connector assembly of claim 1, wherein the cavity of the female component has a depth; and the first housing of the male component has a length; the length of the male component first housing being approximately equal to the depth of the female component cavity.

8. The connector assembly of claim 7, wherein the top end of the male component has a diameter, the diameter being less than the length of the male component.

9. The connector assembly of claim 1, wherein the male component is rigidly connected to a fixture or an appliance.

10. The connector assembly of claim 1, wherein the female component is rigidly connected to a millwork element.

11. The connector assembly of claim 1, wherein the male component is rigidly connected to a light fixture.

12. The connector assembly of claim 1, wherein the male component forms part of a light fixture.

13. The connector assembly of claim 1, wherein the second electrical lead is connected to a source of AC DC current.

14. A system of electrical connectors, comprising:

at least one male component, comprising:

a first housing having a top end and a bottom end, at least a portion of the first housing having a taper, the bottom end having a substantially fiat base; and a first electrical lead running through the first housing from the top end through to the bottom end, so that a first electrical contact is exposed at the base; and a panel of female components, each female component comprising:

a second housing having a top end and a bottom end and defining an interior cavity open at the top end and having a substantially flat base inside the cavity, at least a portion of the cavity having a taper corresponding to the taper of the first housing of the male component, so that each female component is capable of a secure frictional fit when mated together with the at least one male component, and so that the female component and the male component together are resistant to contact separation under vertical, horizontal or radial loads; and a second electrical lead running through the second housing from the bottom end through to the cavity, so that a second electrical contact is exposed at the base of the cavity;

the first and second electrical contacts being situated so as to meet and contact each other when the male and female components are mated together;

one of either the male component or the female component having a magnet mounted thereon and the other of the male component or the female component having a magnet-sensitive material, so that the male and female components are attracted together by magnetic force;

each of the male and female components having a generally circular cross-section and at least one of the male component and the female component being rotatable with respect to the other component.

* * * * *